US005833772A

United States Patent [19]

L'Estrade et al.

[11] Patent Number: 5,833,772

[45] Date of Patent: Nov. 10, 1998

[54] SILICON ALLOY, METHOD FOR PRODUCING THE ALLOY AND METHOD FOR PRODUCTION OF CONSOLIDATED PRODUCTS FROM SILICON

[75] Inventors: Leif L'Estrade, Hoganas, Sweden; Karl Forwald, Kristiansand; Gunnar Schussler, Drammen, both of Norway

[73] Assignee: Elkem ASA, Norway

[21] Appl. No.: 746,438

[22] Filed: Nov. 8, 1996

Related U.S. Application Data

[63] Continuation of Ser. No. 436,384, filed as PCT/NO93/00171 Nov. 17, 1993 published as WO94/11138 May 26, 1994, abandoned.

[30] Foreign Application Priority Data

Nov. 18, 1992 [NO] Norway ..... 924442

[51] Int. Cl.[6] ..... C22C 1/04; B22F 1/00

[52] U.S. Cl. ..... 148/400; 148/442; 420/978; 419/66

[58] Field of Search ..... 148/400, 442; 420/578; 419/66

[56] References Cited

U.S. PATENT DOCUMENTS

| | | | |
|---|---|---|---|
| 4,402,905 | 9/1983 | Burke et al. | 420/537 |
| 4,830,820 | 5/1989 | Itoh et al. | 420/590 |
| 5,094,832 | 3/1992 | Forwald et al. | 423/349 |

FOREIGN PATENT DOCUMENTS

| | | |
|---|---|---|
| 4-100693 | 4/1992 | Japan . |
| 396409 | 1/1974 | U.S.S.R. . |
| 422786 | 9/1974 | U.S.S.R. . |
| 986951 | 1/1983 | U.S.S.R. . |
| 404463 | 1/1934 | United Kingdom . |

OTHER PUBLICATIONS

L.F. Mondolfo, "Aluminum Alloys: Structure and Properties", 1976, Butterworth & Co. (London), pp. 614–615.

*Primary Examiner*—Sikyin Ip
*Attorney, Agent, or Firm*—Bierman, Muserlian and Lucas

[57] ABSTRACT

The invention relates to a rapidly solidified silicon-based alloy, containing 2–40% by weight Al, 2–45% by weight Ti, 0–10% by weight of one or more of the elements V, Cr, Fe, Mn, Ni, Co, 0–1% by weight of one or more of the elements B, Sr and P, the rest, except for impurities, being silicon in an amount of at least 35% by weight. The invention further relates to a method for producing such alloys where a molten alloy is provided and is solidified at a rate of solidification of at least $10^{3°}$ C./second. Consolidated products are produced from the silicon-based alloy by forming articles from powdered alloy and consolidating the formed articles.

20 Claims, No Drawings

SILICON ALLOY, METHOD FOR PRODUCING THE ALLOY AND METHOD FOR PRODUCTION OF CONSOLIDATED PRODUCTS FROM SILICON

This is a continuation of application Ser. No. 08/436,384, filed as PCT/NO93/00171 Nov. 17, 1993 published as WO94/11138 May 26, 1994, now abandoned.

TECHNICAL FIELD

The present invention relates to silicon based aluminium and titanium-containing alloys and powder-based products produced from such alloys. The invention further relates to a method for producing silicon based aluminium- and titanium-containing alloys and a method for producing shaped articles from such alloys.

BACKGROUND ART

Silicon has up till now been used as a raw material for producing silanes, electronic products and as an alloying element for steel and aluminium. When used as an alloying element for steel, silicon is normally added in the form of ferrosilicon in amounts normally below 4% by weight of silicon. When used as an alloying element for aluminium and aluminium alloys silicon is added as elemental silicon. The content of silicon in aluminium alloys varies, but may, for aluminium-silicon alloys, be added in an amount of maximum 20% by weight of the alloys.

Elemental silicon is very brittle and lacks ductility. Addition of silicon to, for example, aluminium alloys thus causes an increased brittleness of the alloys when the silicon content exceeds about 20% by weight. As far as the inventors know, silicon-based alloys do not exist which have such properties that the alloy can be used for structural purposes.

Silicon has, however, a number of properties which makes use of silicon-based alloys very interesting for structural applications. Silicon has a low density of 2.3 g/cm$^3$ and a high melting point of 1410° C. Silicon based alloys having a sufficient ductility and strength would thus have a number of advantages compared with other light metals such as, for example Al, Ti, Mg and Be. This relates particularly to properties like high stiffness in relation to weight, low thermal expansion, high resistance to corrosion, high resistance against erosion, and use at higher temperatures than other light metals.

In the following table some properties for silicon compared to the same properties for Mg, Al, Ti, and stainless 18/8 steel are shown.

| | Si | Mg | Al | Ti | 18/8 steel |
|---|---|---|---|---|---|
| Density (g/cm$^3$) | 2.3 | 1.7 | 2.7 | 4.5 | 8.1 |
| E-module (GPa) | 113 | 44 | 71 | 106 | 200 |
| Stiffness/density-ratio | 4.8 | 2.1 | 2.6 | 2.4 | 2.5 |
| Melting point (°C.) | 1410 | 650 | 660 | 1660 | 1400 |
| Thermal expansion ($10^{-6}$/K) | 2.5 | 26 | 23 | 10 | 18 |
| Thermal conductivity (J/smK) | 84 | 160 | 190 | 19 | 14 |
| Heat capacity (J/gK) | 0.71 | 1.03 | 0.90 | 0.53 | 0.48 |

DISCLOSURE OF INVENTION

It is an object of the present invention to provide silicon-based alloys having such a ductility and strength that the alloys can be used for structural purposes and where the alloys still have the good properties of silicon.

Thus, according to a first aspect the present invention relates to a rapidly solidified silicon-based alloy, which alloy contains 2–40% by weight Al, 2–45% by weight Ti, 0–10% by weight of one or more of the elements V, Cr, Mn, Fe, Ni, Co, 0–1% by weight of one or more of the elements B, Sr, P, the rest, except for normal impurities, being silicon in an amount of at least 35% by weight.

According to a preferred embodiment, the silicon alloy contains 10–30% by weight Al and 3–15% by weight Ti.

According to another preferred embodiment the silicon alloy contains 2–10% by weight Al and 25–40% by weight Ti.

The alloy according to the present invention preferably contains boron in an amount of 0.01–0.1% by weight, and/or phosphorous in an amount of 0.01–0.05% by weight and/or strontium in an amount of 0.05–0.5% by weight The content of the elements V, Cr, Mn, Fe, Ni and Co is preferably between 1 and 3% by weight.

The rapidly solidified alloy preferably has a primary grain size of less than 50 micron and more preferred less than 10 micron. In order to obtain a highest possible strength and ductility it is particularly preferred that the solidified alloy and precipitated intermetallic phases have a primary grain size of less than 1 micron.

According to a second aspect, the present invention relates to a method for production of rapidly solidified silicon-based alloy, said method being characterized in that it is provided a molten alloy containing 2–40% by weight Al, 2–45% by weight Ti, 0–10% by weight of one or more of the elements V, Cr, Mn, Fe, Ni and Co, 0–1% by weight of one or more of the elements B, Sr and P, the rest, except for impurities, being silicon in an amount of at least 35% by weight, which melt is solidified at a rate of at least $10^{3°}$ C./second.

According to a preferred embodiment the melt is solidified at a rate of between $10^{4°}$ and $10^{6°}$ C./second.

The solidification is preferably done by melt spinning or by gas atomization. It is, however, within the scope of the present invention to use other known methods to achieve a sufficiently high solidification rate.

According to a third aspect, the present invention relates to a method for producing consolidated articles from a rapidly solidified silicon-based alloy wherein the rapidly solidified silicon-based alloy containing 2–40% by weight Al, 2–45% by weight Ti, 0–10% by weight of one or more of the elements V, Cr, Mn, Fe, Ni, Co, 0–1% by weight of one or more of the elements B, Sr and P, the rest, except for impurities, being silicon in an amount of at least 35% by weight, is crushed and milled to a particle size below 500 microns and formed to articles by means of powdermetallurgical methods, whereafter the formed articles are hot consolidated.

According to a preferred embodiment the rapidly solidified silicon-based alloy is milled to a particle size below 200 microns before the articles are formed.

Forming of articles and consolidation of the formed articles are done by conventional powdermetallurgical methods. It is preferred to use hot isostatic pressing, but it is within the scope of the present invention to use for example cold isostatic pressing followed by sintering, hot single axial pressing, forging, extruding and injection casting followed by sintering.

It has surprisingly been found that the consolidated articles made from the silicon-based alloy according to the present invention have very high compression strength and a sufficiently high ductility such that the products can be used for structural purposes.

By rapid solidification of the silicon-based alloy according to the present invention a very fine grained material is obtained which has an exceptional good distribution of intermetallic phases in the material and very small grains. It is assumed that it is this combination which give the material its high ductility and high strength. By hot consolidation of the articles according to the present invention, it is important to use such a combination of temperature and pressure that the finished products become sufficiently dense and that grain growth during the consolidation process does not affect the properties of the material.

DETAILED DESCRIPTION OF PREFERRED EMBODIMENTS

EXAMPLE 1

A silicon alloy containing 25% by weight of Al, 5% by weight of Ti, the rest except for normal impurities being silicon, was melted in a vacuum furnace and cast in the form of rods. The rods were used as a raw material for melt spinning. By the melt spinning the rods were melted and cast to thin sheets or ribbons with a solidification rate of above $10^{4°}$ C./second. The ribbons were milled in a closed mill to a particle size of less than 200 microns.

The alloy particles were thereafter filled into a cylinder-shaped mould having a diameter of 1 cm and a height of more than 1 cm. The alloy particles were thereafter pressed for two hours using single-axial pressure of 40 MPa and at a temperature of 700° C.

The produced articles were thereafter tested by compression. The ultimate strength was mesured to 878 MPa and the change in length during compression was 7%.

The results show that the produced alloy has a very high compression strength and a compression length comparable to fiber-reinforced aluminium.

EXAMPLE 2

Five alloys were made in powder form using the same procedure as described in Example 1.

Alloy 1: 25% by weight Al, 5% by weight Ti, 0.01% Sr, the rest being silicon.

Alloy 2: 15% by weight Al, 5% by weight Ti, the rest being silicon

Alloy 3: 35% by weight Al, 5% by weight Ti, the rest being silicon.

Alloy 4: 25% by weight Al, 5% by weight Ti, the rest being silicon.

Alloy 5: 5% by weight Al, 35% by weight Ti, the rest being silicon.

Alloys 1 through 5 were subjected to hot pressing and the fracture strength and compression length were measured. The results are shown in Table I.

TABLE I

| | Hot pressing parameters | | | Fracture Strength | Compression |
|---|---|---|---|---|---|
| Alloy | Temp (°C.) | Time (min.) | Load (kg) | (MPa) | Length % |
| 1 | 700 | 120 | 530 | 1196 | 7.5 |
| 2 | 700 | 120 | 420 | 926 | 5.4 |
| 3 | 625 | 120 | 420 | 723 | 5.4 |

TABLE I-continued

| | Hot pressing parameters | | | Fracture Strength | Compression |
|---|---|---|---|---|---|
| Alloy | Temp (°C.) | Time (min.) | Load (kg) | (MPa) | Length % |
| 4 | 700 | 120 | 420 | 978 | 7.7 |
| 5 | 1125 | 120 | 420 | 664 | 5.9 |

Table I shows that the hot pressed products had a very high strength and a good compression length.

We claim:

1. A rapidly solidified silicon-based alloy comprising:

(a) said alloy having a primary grain size of less than about 50 microns;

(b) said alloy having a chemical composition consisting of:

($b_1$) about 2–40% by weight Al, ($b_2$) about 15–45% by weight Ti, ($b_3$) about 0–10% by weight of at least one element selected from the group consisting of V, Cr, Mn, Fe, Ni, and Co, ($b_4$) about 0–1% by weight of at least one element selected from the group consisting of B, Sr and P, and ($b_5$) a remainder of silicon in an amount of at least about 35% by weight along with inevitable impurities.

2. The silicon-based alloy according to claim 1, wherein said alloy has about 10–30% by weight Al.

3. The silicon-based alloy according to claim 1, wherein said alloy has about 2–10% by weight Al and about 25–40% by weight Ti.

4. The silicon-based alloy according to claim 3 wherein said alloy has B in an amount of about 0.01–0.1% by weight.

5. The silicon-based alloy according to claim 3 wherein said alloy has P in an amount of about 0.01–0.05% by weight.

6. The silicon-based alloy according to claim 3 wherein said alloy has Sr in an amount of about 0.05–0.5% by weight.

7. The silicon-based alloy according to claim 6 wherein said alloy has at least one element selected from the group consisting of V, Cr, Mn, Fe, Ni and Co in an amount of about 1–3% by weight.

8. The silicon-based alloy according to claim 7 wherein said alloy has a primary grain size of less than about 10 microns.

9. A method for production of a particulate silicon-based alloy for use in the manufacture of compact articles, said method comprising the steps of:

(a) forming a melt consisting of:

($a_1$) about 2–40% by weight Al, ($a_2$) about 15–45% by weight Ti, ($a_3$) about 0–10% by weight of at least one element selected from the group consisting of V, Cr, Mn, Fe, Ni and Co, ($a_4$) about 0–1% by weight of at least one element selected from the group consisting of B, Sr and P, and ($a_5$) a remainder of silicon in an amount of at least about 35% by weight along with inevitable impurities;

(b) rapidly solidifying said melt to form a solidified silicon-based alloy, said rapid solidification occurring at a solidification rate of at least about $10^{3°}$ C./second, said solidified silicon-based alloy having a grain size less than about 50 microns; and (c) crushing and milling said solidified silicon-based alloy to produce a particulate silicon-based alloy having a particle size below about 500 microns.

10. The method according to claim 9 wherein said step of rapidly solidifying said melt occurs at a solidification rate between about $10^{4°}$ and $10^{6°}$ C./second.

11. A method for production of a formed article from a rapidly solidified silicon-based alloy, said method comprising the step of:

(a) forming a melt consisting of:

($a_1$) about 2–40% by weight Al, ($a_2$) about 15–45% by weight Ti, ($a_3$) about 0–10% by weight of at least one element selected from the group consisting of V, Cr, Mn, Fe, Ni, and Co, ($a_4$) about 0–1% by weight of at least one element selected from the group consisting of B, Sr, and P, and ($a_5$) a remainder of silicon in an amount of at least about 35% by weight along with inevitable impurities;

(b) rapidly solidifying said melt to form a solidified silicon-based alloy, said rapid solidification occurring at a solidification rate of at least about $10^{3°}$ C./second, said solidified silicon-based alloy having a grain size less than about 50 microns;

(c) crushing and milling said solidified silicon-based alloy to form a particulate silicon-based alloy having a particle size below about 500 microns;

(d) pressing said particulate silicon-based alloy into a formed article.

12. The method according to claim 11 wherein said solidified silicon-based alloy is crushed and milled to form a particulate silicon-based alloy having a particle size below about 200 microns.

13. A particulate silicon-based alloy made by a process comprising the steps of:

(a) forming a melt consisting of:

($a_1$) about 2–40% by weight Al, ($a_2$) about 15–45% by weight Ti, ($a_3$) about 0–10% by weight of at least one element selected from the group consisting of V, Cr, Mn, Fe, Ni and Co, ($a_4$) about 0–1% by weight of at least one element selected from the group consisting of B, Sr and P, and ($a_5$) a remainder of silicon in an amount of at least about 35% by weight along with inevitable impurities;

(b) rapidly solidifying said melt to form a solidified silicon-based alloy, said rapid solidification occurring at a solidification rate of at least about $10^{3°}$ C./second, said solidified silicon-based alloy having a grain size less than about 50 microns; and (c) crushing and milling said solidified silicon-based alloy to produce a particulate silicon-based alloy having a particle size below about 500 microns.

14. The particulate silicon-based alloy according to claim 13 wherein said step of rapidly solidifying said melt occurs at a solidification rate between about $10^{4°}$ and $10^{6°}$ C./second.

15. The particulate silicon-based alloy according to claim 13 wherein said solidified silicon-based alloy is crushed and milled to form a particulate silicon-based alloy having a particle size below about 200 microns.

16. The particulate silicon-based alloy according to claim 13 wherein said melt has about 10–30% by weight Al.

17. The particulate silicon-based alloy according to claim 13 wherein said melt has about 2–10% by weight Al and about 25–40% by weight Ti.

18. The particulate silicon-based alloy according to claim 17 wherein said melt has B in an amount of about 0.01–0.1% by weight.

19. The particulate silicon-based alloy according to claim 17 wherein said melt has P in an amount of about 0.05–0.5% by weight.

20. The formed article made by the process of claim 11.

* * * * *